US011280575B1

(12) United States Patent
Rentz

(10) Patent No.: US 11,280,575 B1
(45) Date of Patent: Mar. 22, 2022

(54) HANDHELD PULL TENSION ARCHERY RELEASE

(71) Applicant: Gregory E. Summers, Madison Heights, VA (US)

(72) Inventor: Marc Rentz, Madison Heights, VA (US)

(73) Assignee: Gregory E. Summers Trust Agreement Dated December 8, 2006, Madison Heights, VA (US)

( * ) Notice: Subject to any disclaimer, the term of this patent is extended or adjusted under 35 U.S.C. 154(b) by 0 days.

(21) Appl. No.: 17/163,644

(22) Filed: Feb. 1, 2021

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469; F41B 7/025
See application file for complete search history.

(56) References Cited

U.S. PATENT DOCUMENTS 2,550,873 A * 5/1951 Siders ..... F41B 7/025 124/19
2,610,619 A * 9/1952 Mikkelson, Jr. ..... F41B 7/025 124/19
5,205,266 A * 4/1993 Kilby, Jr. ..... F41B 7/025 124/19
5,692,490 A * 12/1997 Walker ..... F41B 5/1469 124/35.2
5,694,915 A 12/1997 Summers
8,622,051 B2 1/2014 Summers et al.
9,429,384 B2 * 8/2016 Whalen ..... F41B 5/1469
9,618,295 B1 * 4/2017 Rentz ..... F41B 5/1469
9,625,230 B2 * 4/2017 Kelly ..... F41B 5/1469
9,863,736 B2 * 1/2018 Kelly ..... F41B 5/1469
10,145,646 B2 * 12/2018 Kelly ..... F41B 5/1469
10,801,803 B1 * 10/2020 Rentz ..... F41B 5/1469

* cited by examiner

*Primary Examiner* — John A Ricci
(74) *Attorney, Agent, or Firm* — Leading Edge Law Group PLC

(57) ABSTRACT

A handheld pull tension archery release includes a handle containing a finger opening having an axis arranged normal to a plane containing the handle, a ring sear assembly arranged in the handle, and a bail connected with the handle for rotation about an axis parallel to the opening axis. The bail is configured to grip a bowstring. When the ring sear assembly is actuated, a ring sear arranged in the housing rotates about the finger opening axis from a hold position engaging the bail to a release position releasing the bail to free the bowstring and fire an arrow. Rotation of the ring sear is in response to pull tension on the bowstring and actuation of a thumb trigger connected with the handle.

17 Claims, 10 Drawing Sheets

HANDHELD PULL TENSION ARCHERY RELEASE

BACKGROUND OF THE INVENTION

The present invention relates to an archery release, and more particularly to a handheld pull tension archery release for a bowstring suitable for use with multiple shooting styles.

Release devices are used in archery to assist the archer in pulling a bowstring to a fully drawn position and then releasing the bowstring to fire an arrow. Some release devices use grippers for engaging the bowstring or a nock mounted on the bowstring. Other release devices use a rope looped about the bowstring. The present invention relates to a new release which is activated via a thumb trigger and utilizes pull through tension exceeding bow let-off poundage.

BRIEF DESCRIPTION OF THE PRIOR ART

Back-tension release devices which reduce torque are well-known in the prior art as evidenced by U.S. Pat. No. 5,694,915. This patent discloses a back-tension rope release in which a catch for a rope loop is connected with a fork which in turn is connected with a handle. The orientation of the fork relative to the handle is adjustable in order to remove torque or twist from a rope loop. The catch is also adjustable relative to the fork in order to adjust the back-tension travel to fire the bow. Set screws are used to hold the fork and the catch in the desired positions.

Another back-tension release device is disclosed in U.S. Pat. No. 8,622,051 wherein an adjustable sear housing and an adjustable finger are provided. By adjusting the sear housing, twist or torque in a bowstring loop connected with the release can be eliminated. The speed of the release is altered via adjustment of the finger.

While the prior devices normally operate satisfactorily, they are somewhat cumbersome to operate and often require re-adjustment because the set screws loosen during repeated firing of the release. In addition, they do not accommodate various shooting styles. The present invention was developed in order to overcome these and other drawbacks of prior archery releases by providing a handheld pull tension archery release.

SUMMARY OF THE INVENTION

Accordingly, it is a primary object of the invention to provide a release including a handle containing a finger opening having an axis arranged normal to a plane containing the handle and a bail rotatably connected with the handle. The bail includes at least two radially extending projections configured to grip a bowstring and to engage a ring sear assembly arranged in the handle coaxial with the opening axis. The ring sear assembly is operable between a hold position engaging a bail projection to prevent the bail from rotating and a release position disengaging the bail for rotation to release the bowstring and fire an arrow.

The ring sear assembly includes a circular ring sear arranged in the handle for rotation about the finger opening axis. The ring sear includes two spaced projections, one of which engages a bail catch pivotally connected with the housing and engaging the bail and the other of which engages an adjustable spring within the handle which biases the ring sear toward the hold position. The outer surface of the ring sear contains a notch between the projections. A thumb trigger is pivotally connected with the handle and operable between a hold position wherein the thumb trigger engages the ring sear notch to prevent rotation of the ring sear and a release position wherein the thumb trigger is disengaged from the notch to permit rotation of the ring sear to the release position.

According to a further object of the invention, the bail includes a base containing a central opening for rotation about an axis and three identical and equally spaced projections extending radially from the base. Each projection includes a concave surface configured for receiving a bowstring and a sear surface configured for engagement by a sear assembly.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
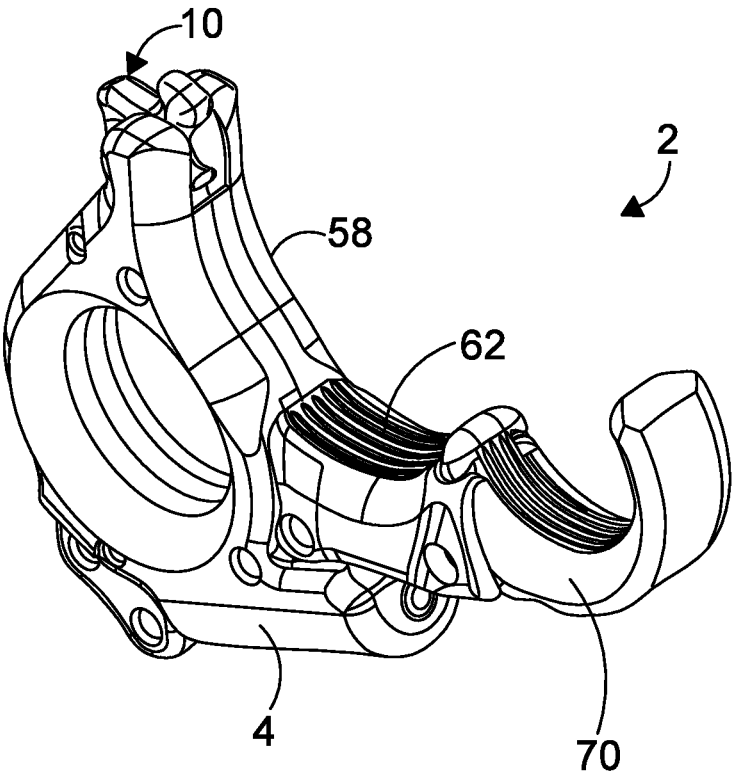
FIGS. 1 and 2 are top rear perspective and bottom front perspective views, respectively, of the handheld pull tension archery release according to the invention.
Figure 2:
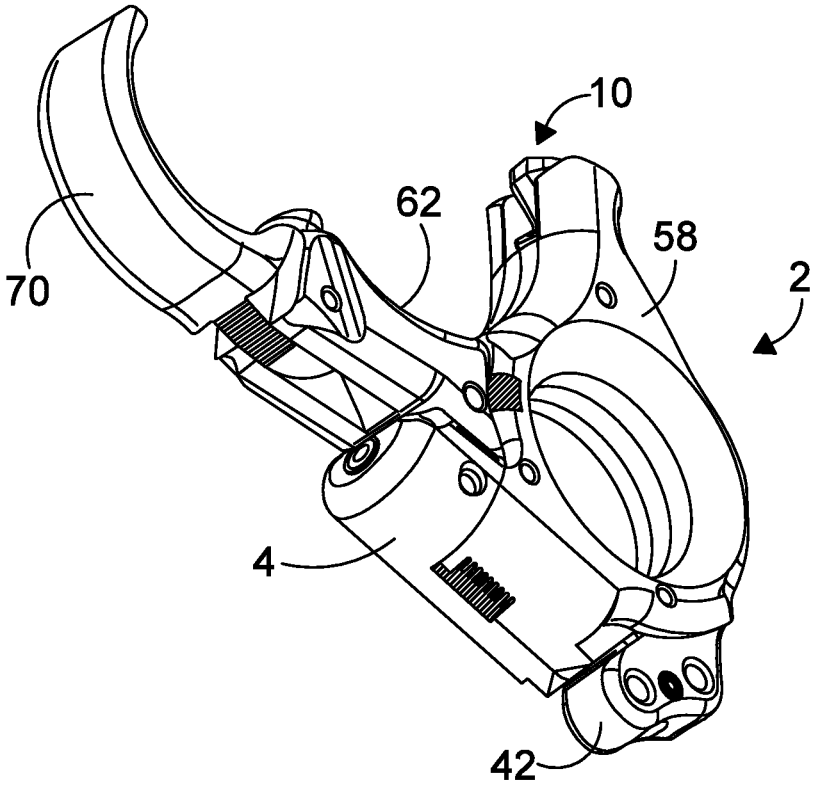

As shown in FIGS. 1-7, the handheld pull tension archery release 2 according to the invention includes a handle 4 arranged in a plane and containing a finger opening 6 having an axis extending normal to the plane of the handle. As will be developed below, the finger opening 6 is configured to receive the index finger of an archer. At its upper or forward end, the handle contains an opening 8. A bail 10 is connected with the handle 4 via a dowel pin 12 which passes through an opening 14 in the central base 16 of the bail and into the opening 8 of the handle. Thus, the bail is rotatably connected with the handle. The axis of rotation of the bail is parallel to the finger opening axis. The handle 4 is shown in greater detail in FIGS. 8-11 and the bail is shown in greater detail in FIGS. 18 and 19

Figure 14:
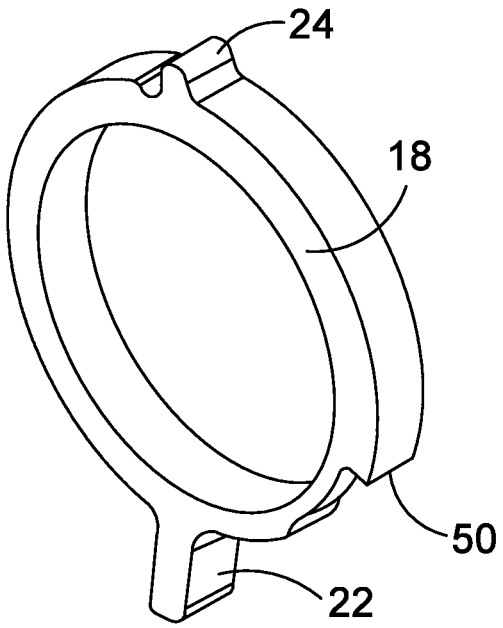
FIGS. 14 and 15 are front and rear perspective views, respectively, of the ring sear of the archery release according to the invention.
Figure 15:
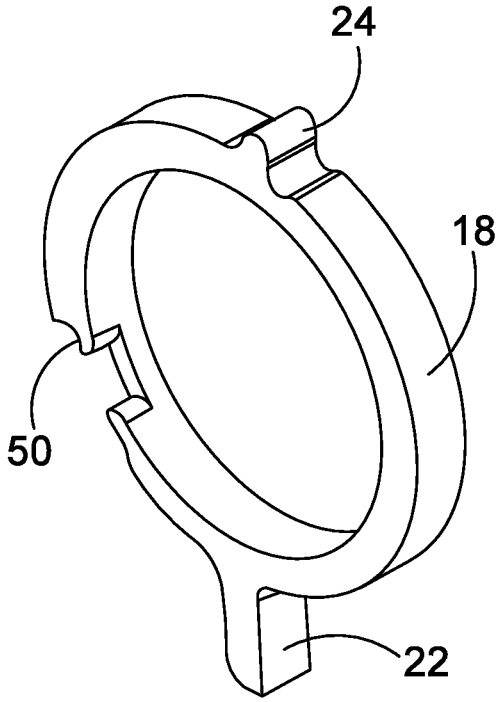
Figure 16:
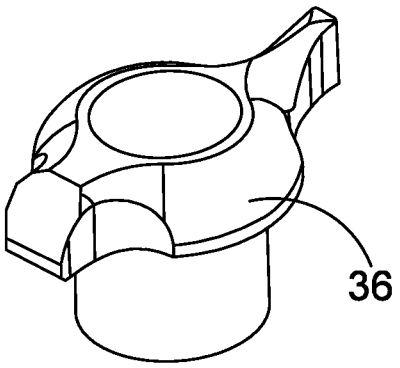
FIGS. 16 and 17 are top and bottom perspective views, respectively, of the spring guide of the archery release according to the invention
Figure 17:
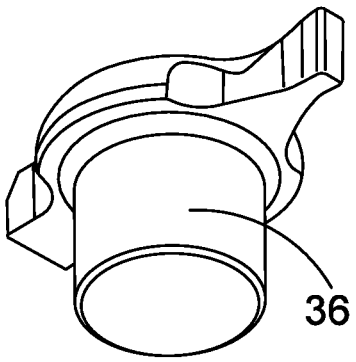

A ring sear assembly is arranged within the handle. The assembly includes a circular ring sear 18 arranged in a channel 20 of the handle in such a manner that limited rotation of the ring sear about the handle finger opening axis is provided. As show in FIGS. 14 and 15, the ring sear 18 includes first 22 and second 24 projections which preferably extend outwardly from the ring sear in generally opposite directions. The first projection 22 is configured to abut against a spring 26 as will be developed below. The second projection is configured to abut against a bail catch 28. The bail catch includes an opening 30 which receives a dowel pin 32 which enters a further opening 34 in the handle. The bail catch pivots relative to the dowel pin and the handle about an axis parallel to the finger opening axis. In addition, the bail catch includes a first end portion 28*a* configured to engage the second projection 24 of the ring sear 18 and a second end portion 28*b* configured to engage the bail.

Figure 4:
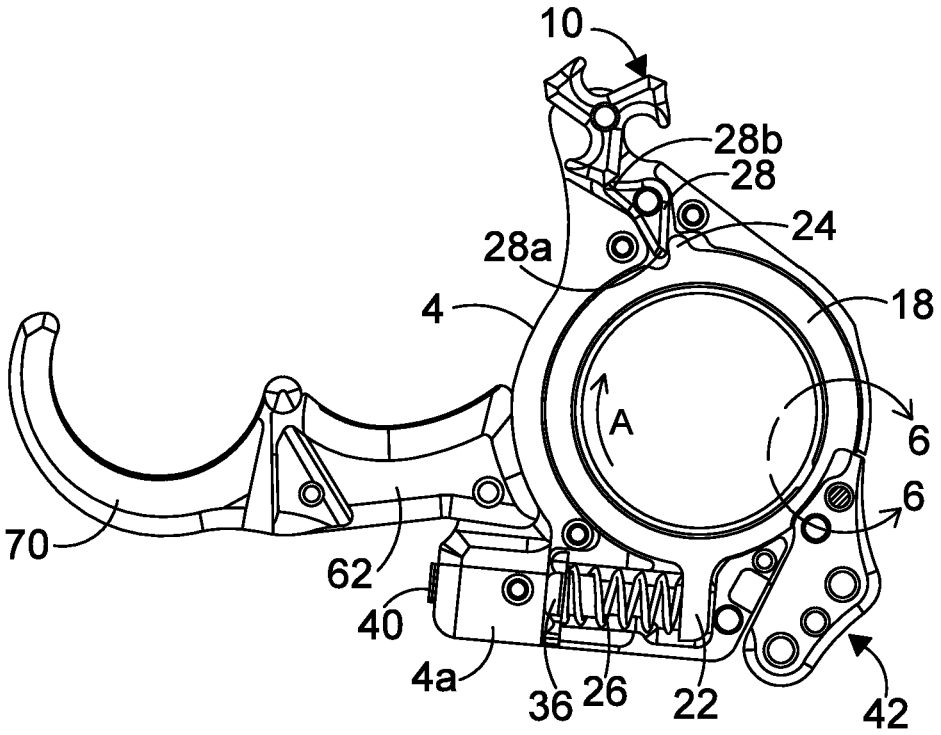
FIGS. 4 and 5 are front elevation views of the archery release with the cover removed in the hold and release positions, respectively.
Figure 5:
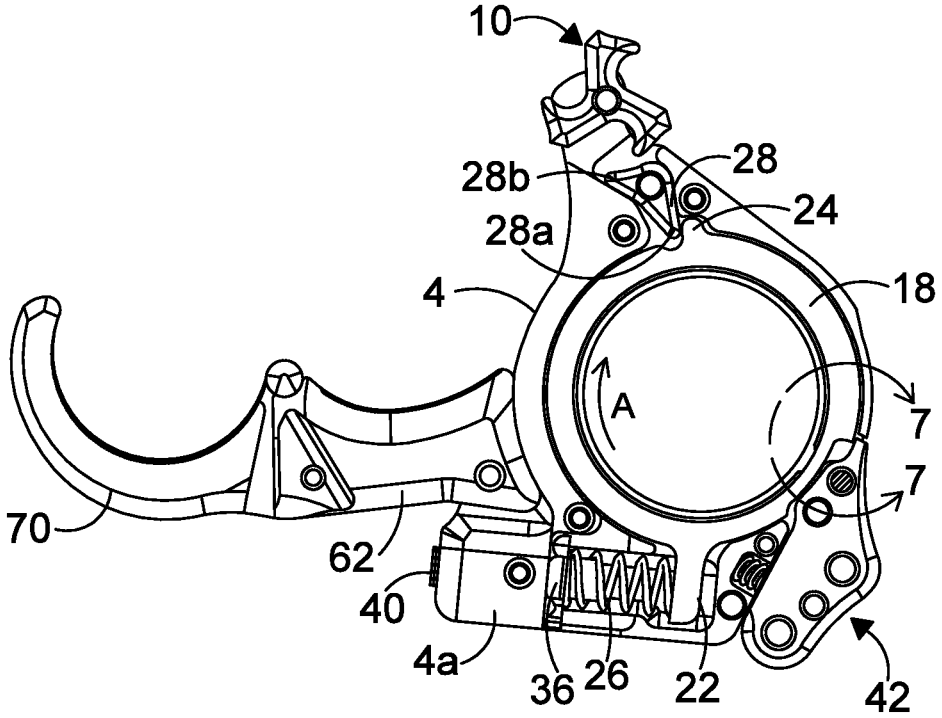

The spring 26 is arranged in a concave region of the handle 4. One end of the spring abuts against a spring guide 36. The other end of the spring abuts against the first projection 22 of the ring sear as shown in FIGS. 4 and 5. The spring guide 36 has an end portion surrounded by the spring. The other end of the spring guide acts as a cap and includes a pair of opposed wing portions which extend outwardly beyond the outer circumference of the spring 26. The handle portion 4*a* includes a threaded through-opening 38 which receives a threaded adjustment screw 40. The interior end of the screw abuts against the cap portion of the spring guide 36. Accordingly, tightening of the screw presses the spring guide against the spring to increase the biasing force of the spring against the ring sear first projection.

A thumb trigger 42 is pivotally connected with the handle via a dowel pin 44 which passes through an opening 46 in the trigger and an opening 48 in the handle. The thumb trigger includes a forward end portion 42*a* which is configured to engage and release a notch 50 in an outer surface of the ring sear 18 between the first and second projections. A spring 52 passes through a threaded opening 54 in the trigger, and an adjustment screw 56 is threaded into the opening 54 to press the spring against the handle. The spring biases the trigger to a return or hold position. A trigger travel screw 57 is arranged in a threaded opening in the thumb trigger to engage the ring sear. Rotation of the trigger travel screw controls the spacing of the trigger end portion 42*a* from the ring sear.

Figure 3:
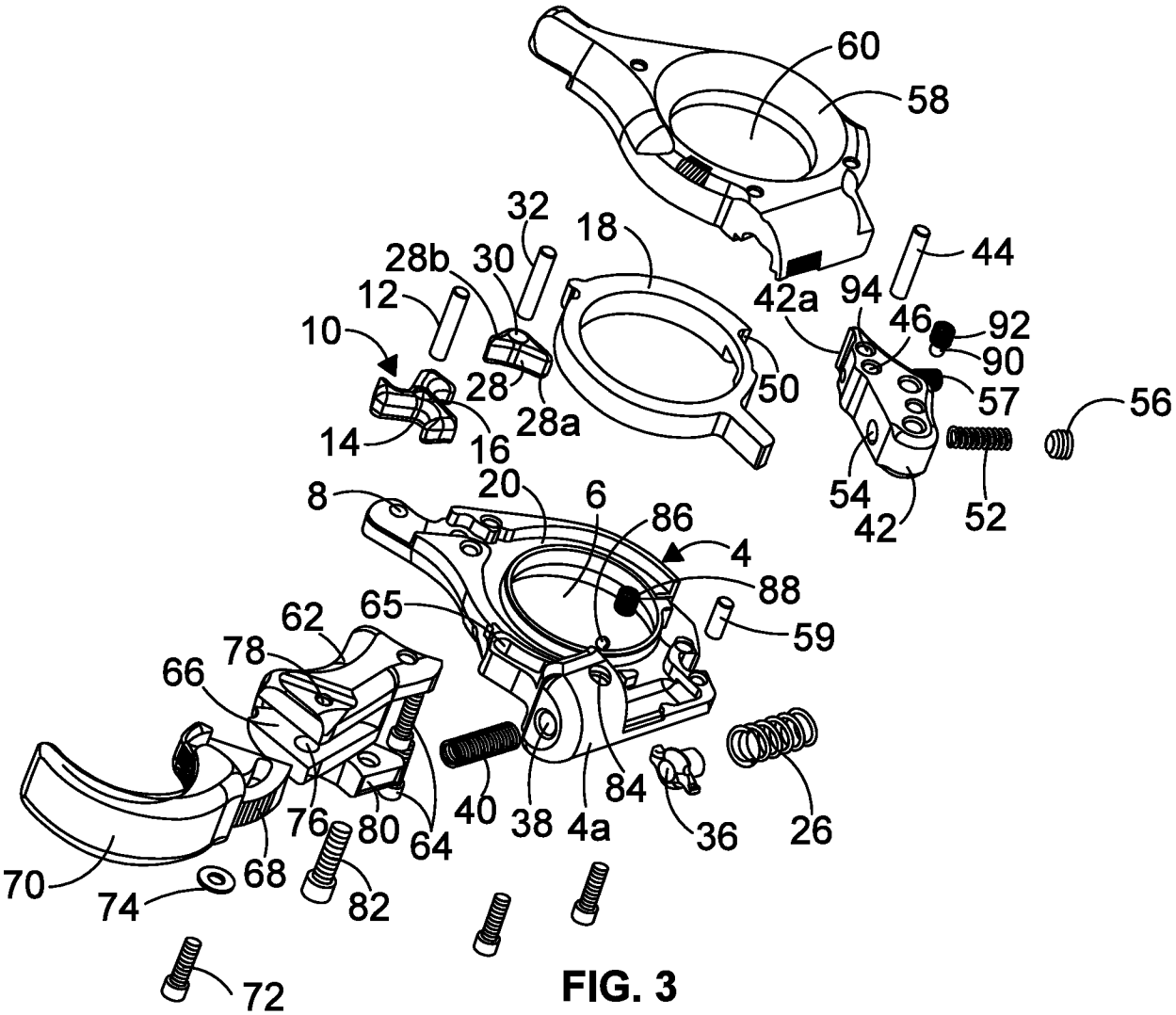
FIG. 3 is an exploded view of the archery release according to the invention.
Figure 12:
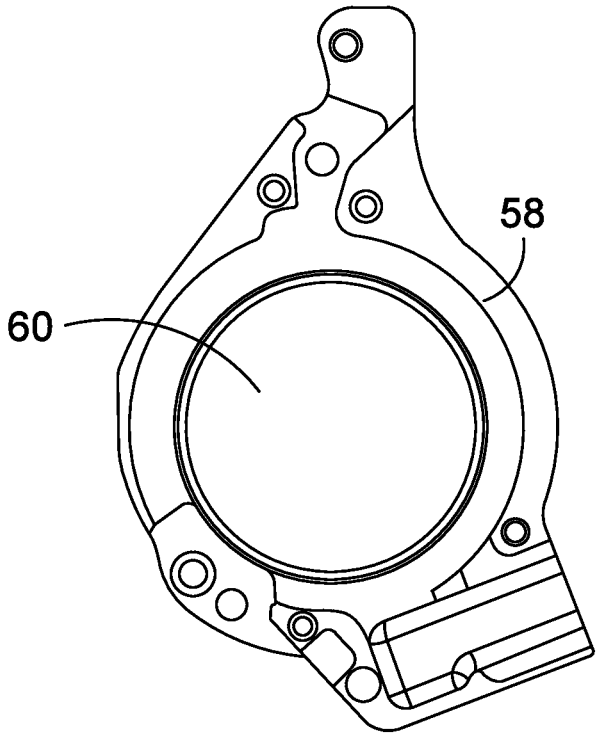
Figure 13:
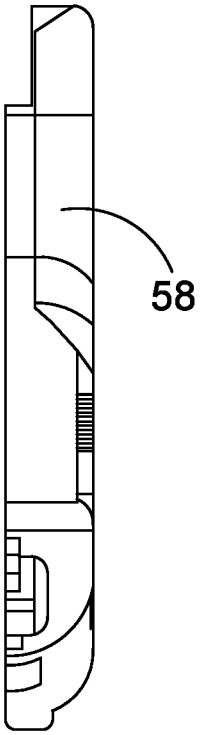

A cover 58 is provided which is connected with the handle 4 via screws (not shown) in a conventional manner. As shown in FIGS. 3, 12, and 13, the cover is configured to match the configuration of the handle and includes a central opening 60 for receiving the archer's index finger. A dowel pin 59 assists with the alignment between the cover 58 and the handle 4

Figure 6:
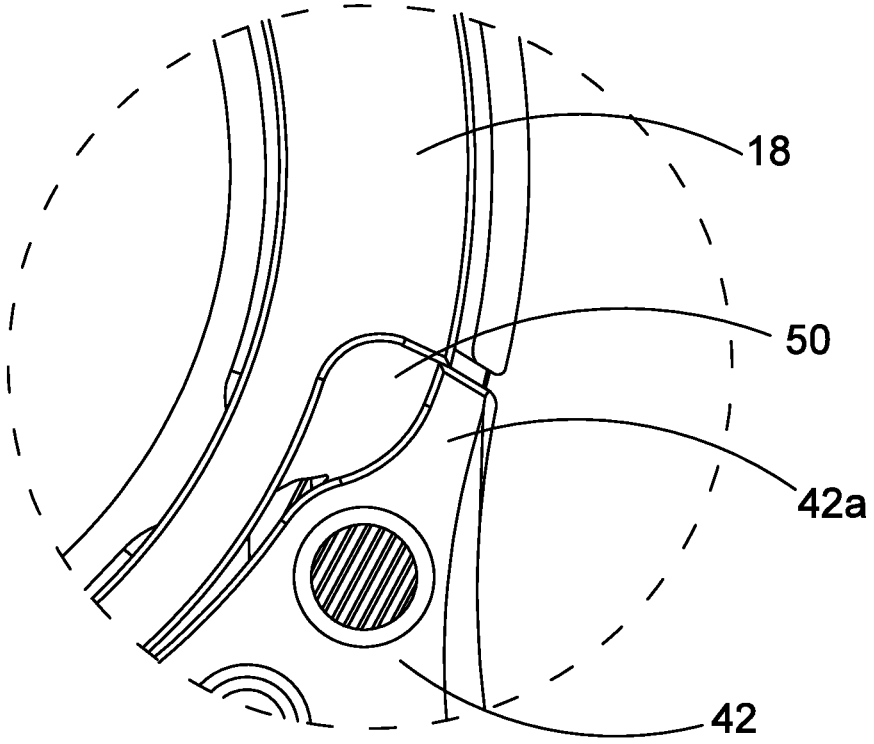
FIGS. 6 and 7 are detailed elevation views of the thumb trigger and ring sear taken along lines 6-6 and 7-7 of FIGS. 4 and 5, respectively.

The operation of the release will be described with reference to FIGS. 4-7. FIGS. 4 and 6 show the release in a hold position. The trigger end portion 42*a* is engaged in the notch 50 in the ring sear to prevent the ring sear from rotating in a clockwise position as shown by the arrow A. The spring 26 presses against the first projection 22 of the ring sear to exert a force on the ring sear in a counterclockwise direction opposite the direction of the arrow A. Opposite the first projection, the second projection 24 of the ring sear engages the first end 28*a* of the bail catch 28. The second end 28*b* of the bail catch engages the bail 10.

Figure 18:
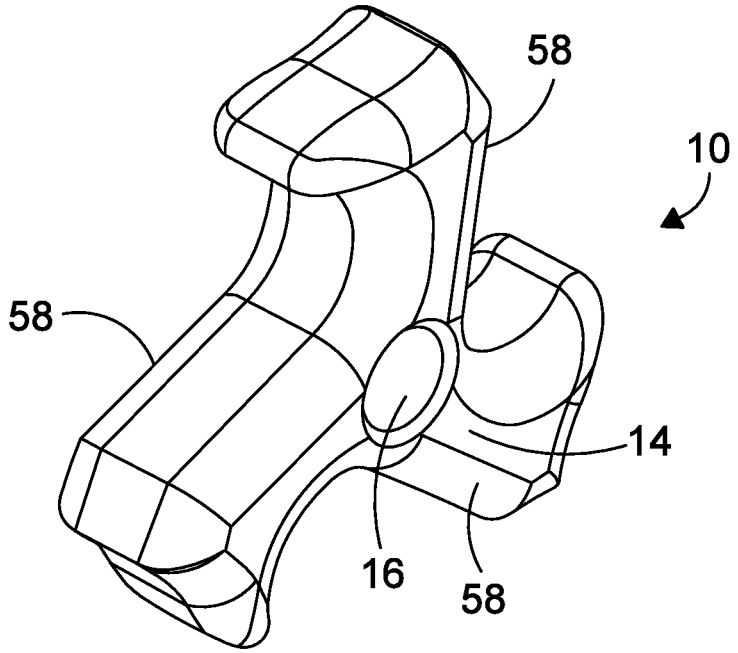
FIGS. 18 and 19 are front perspective and front elevation views, respectively, of the bail of the archery release according to the invention.
Figure 19:
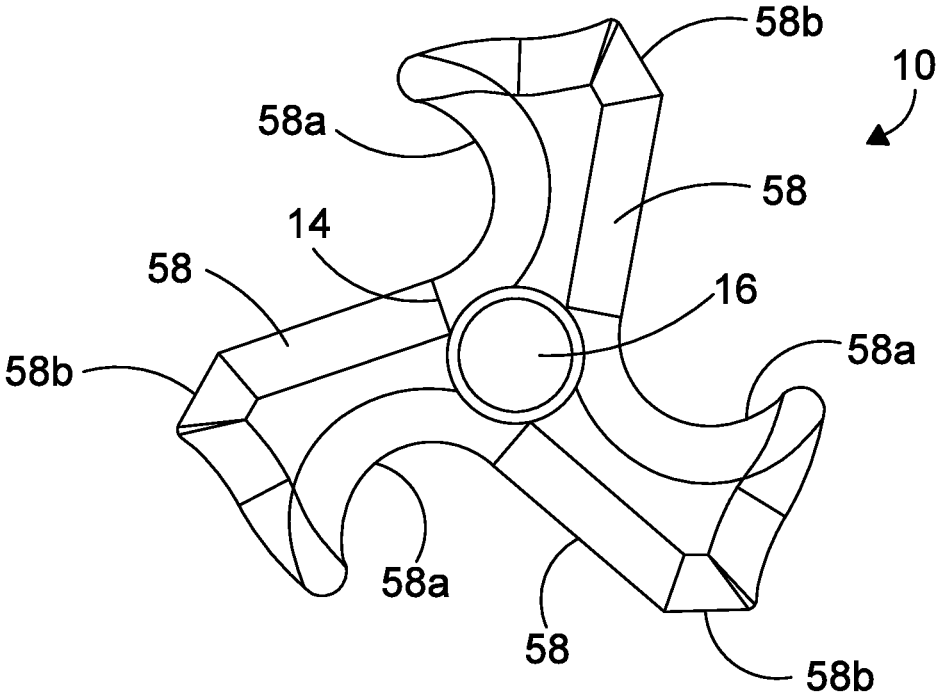
Figure 20:
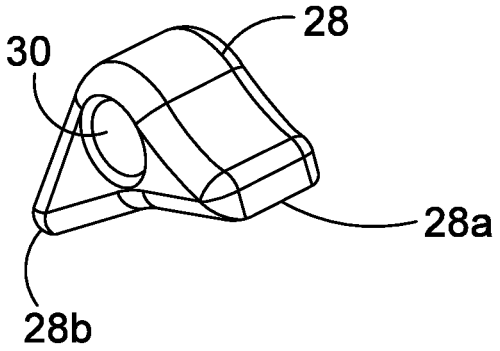
FIGS. 20 and 21 are front perspective and front elevation views, respectively, of the bail catch of the archery release according to the invention.
Figure 21:
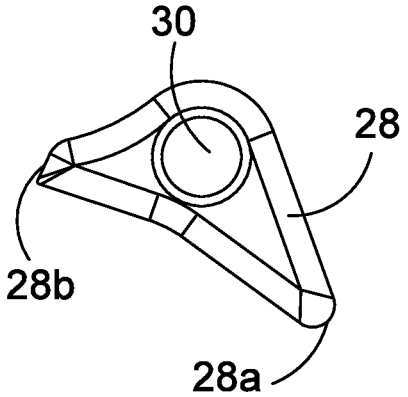
Figure 22:
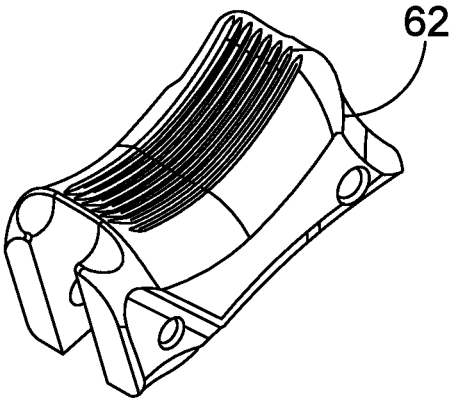
FIGS. 22 and 23 are top and bottom perspective views, respectively, of a finger support of the archery release according to the invention.
Figure 23:
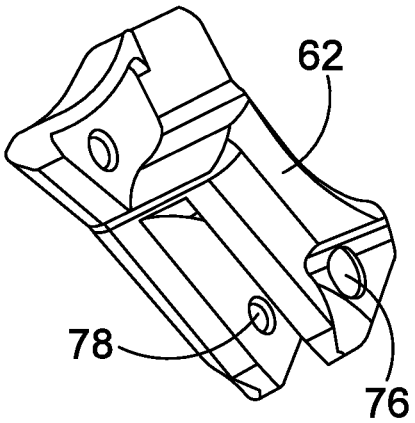

As shown in FIGS. 18 and 19, the bail includes a number of projections 58 which extend radially from the bail base 14. Preferably, three identical projections are provided which are equally spaced about the bail. Each projection includes a concave portion 58*a* for receiving a bowstring and a flattened portion 58*b* on the opposite side of the projection from the concave portion for engagement by a second end 28*b* of the bail catch.

Referring once again to FIGS. 4 and 6, the archer arranges a bowstring in the concave region of an outermost bail projection 58. As the archer pulls the release away from a bow to draw the bowstring in preparation for firing an arrow, the tension of the bowstring creates a rotational force on the bail which presses the next interior bail projection against the bail catch which prevents the bail from rotating. The release sear assembly and bail are thus in a hold position.

Figure 7:
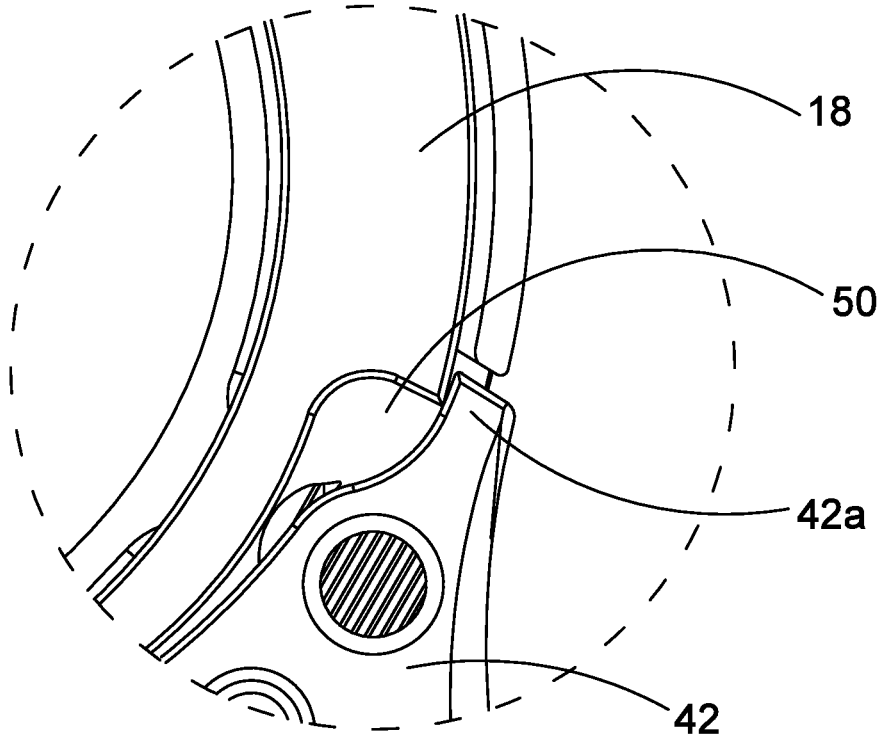
Figure 8:
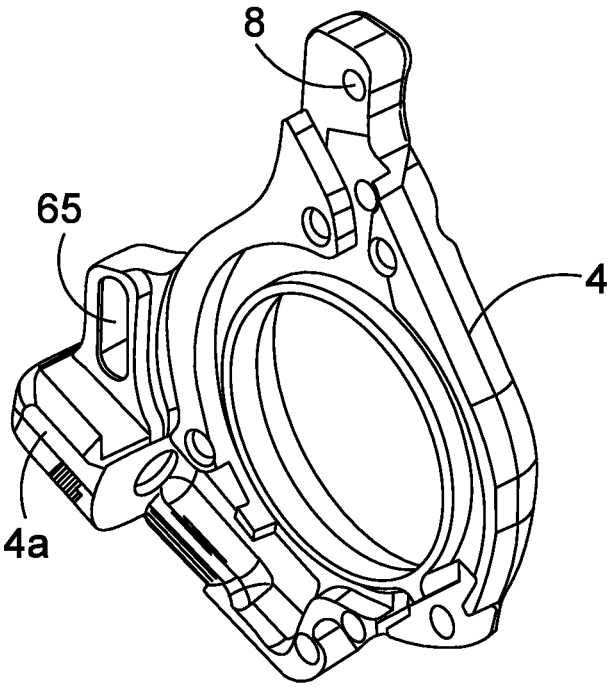
FIGS. 8 and 9 are front perspective and front elevation views, respectively, of the handle of the archery release according to the invention.
Figure 9:
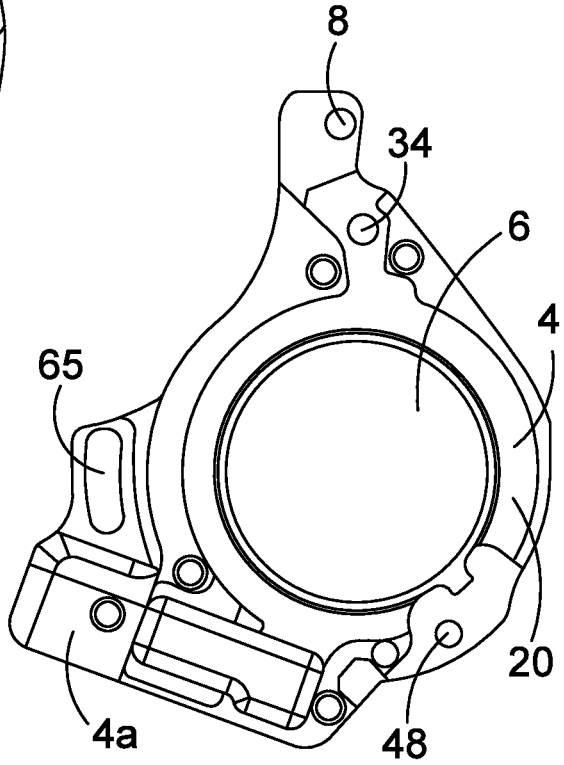
Figure 10:
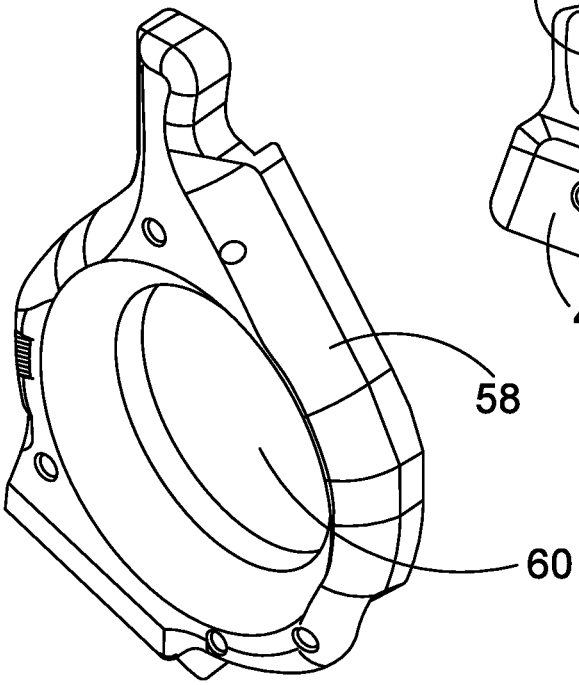
FIGS. 10, 11, 12 and 13 are rear perspective, rear elevation, front elevation and right-side elevation views, respectively, of the cover of the archery release according to the invention.
Figure 11:
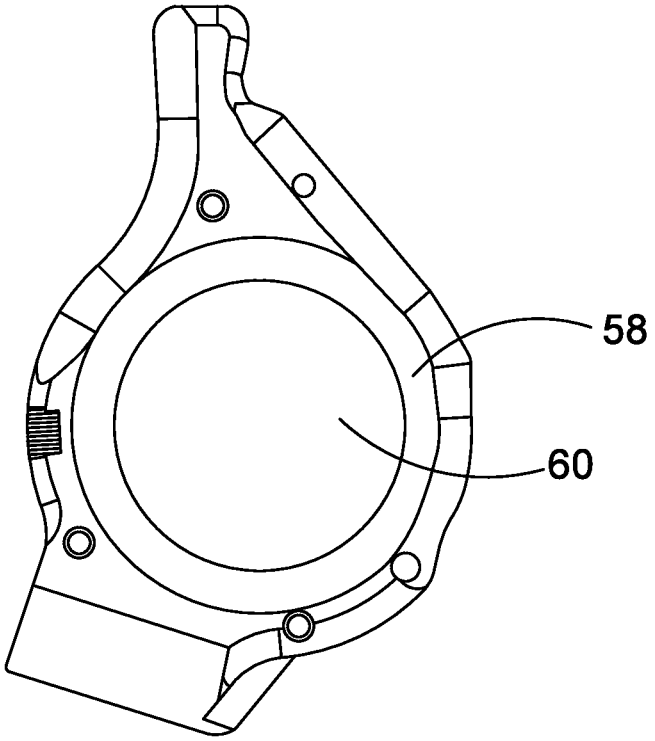

The archer activates the release to fire an arrow by pressing on the thumb trigger 42. This pivots the trigger and moves the end portion 42*a* of the trigger away from the notch 50 in the ring sear as shown in FIGS. 5 and 7. With the ring sear released, it rotates in the clockwise direction as a result of the pull tension from the bowstring. That is, as the ring sear rotates, it allows the bail catch 28 to pivot with movement of the second projection 24 of the ring sear so that the second end 28*b* of the bail catch moves away from the bail to release the bail projection that was engaged by the bail catch. Rotation of the bail releases the bowstring to fire an arrow.

The release is operable in two different modes depending on the compressive force applied to the spring 26 via the adjustment screw 40. For operation as a trigger release, the compressive force on the spring is adjusted to the lightest setting. The archer pulls the bow back and then compresses the thumb trigger allowing the ring sear to rotate and the release to fire as described above. For operation as a tension release, the spring compressive force or pressure is adjusted to approximately five pounds greater than the let-off bow draw poundage. The archer pulls the release back as in the trigger mode and compresses the thumb trigger. After compressing the trigger, the archer then must pull the release back further to overcome the spring pressure allowing the ring sear to rotate and release the ball catch and bail.

The release is configured to provide a visual indication of the spring pressure. The handle 4 contains a recess or slot adjacent to the handle portion 4*a* in which a wing portion of the spring guide 36 is arranged which is visible to the archer. Indicia on the cover 58 adjacent this recess when the release is assembled indicates to the archer the relative position of the spring guide by adjusting the screw 40 to increase or decrease the compressive force applied to the spring.

Other features of the release enhance its performance and allow the archer to customize the release according to his or her preferences.

In this regard, a middle finger support 62 is provided which is connected with the handle 4 via screws 64. More particularly, the screws 64 pass through openings in the middle finger support and through a slot 65 in the handle and into aligned threaded openings in the cover 58. The slot in the handle affords a limited degree of adjustment of the middle finger support relative to the handle when the screws 64 are loose. When the screws are tightened, the middle finger support position is set in the position preferred by the archer.

Figure 24:
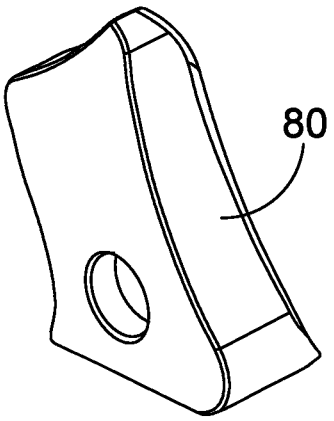
FIGS. 24 and 25 are front and rear perspective views, respectively, of a clamp for the finger support of FIGS. 22 and 23.
Figure 25:
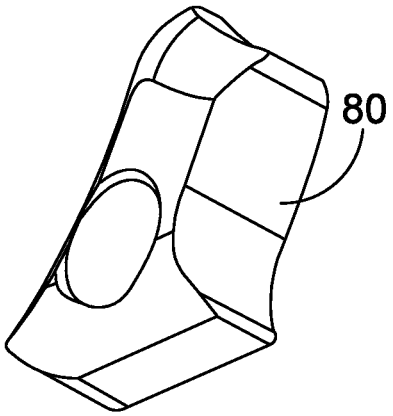
Figure 26:
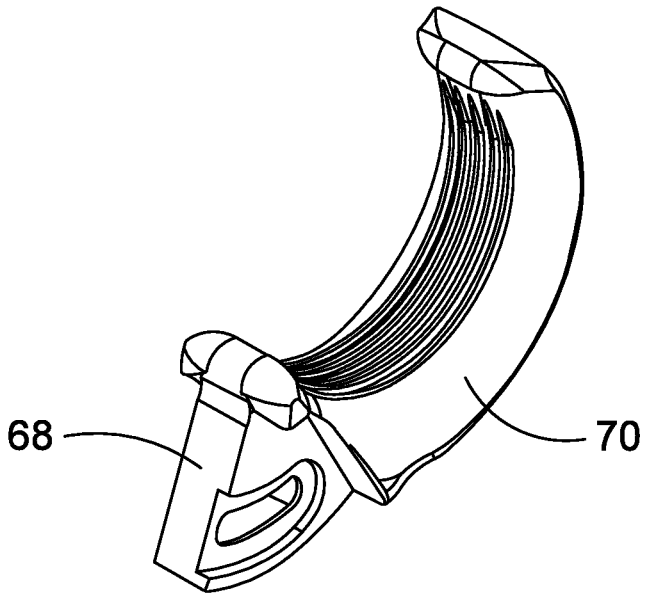
FIGS. 26, 27, and 28 are perspective views of additional finger supports, respectively, for the archery release according to the invention.

The middle finger support contains a channel 66 adapted to receive a slotted projection 68 of a ring or fourth finger support 70 which is also shown in FIG. 26. A screw 72 passes through a washer 74, an opening 76 in the middle finger support, a slot in the projection 68 and into a threaded opening 78 in the middle finger support. With the screw 72 released, the ring finger support 70 can be adjusted relative to the middle finger support 62 to a position selected by the archer. The screw 72 is then tightened to lock the ring finger support in the selected position relative to the middle finger support. A middle finger clamp 80 and clamp screw 82 are provided to clamp the middle finger and ring finger supports in place. The middle finger clamp 80 is shown in detail in FIGS. 24 and 25.

Figure 27:
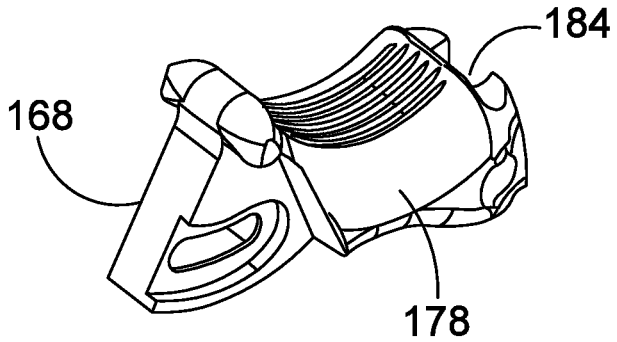
Figure 28:
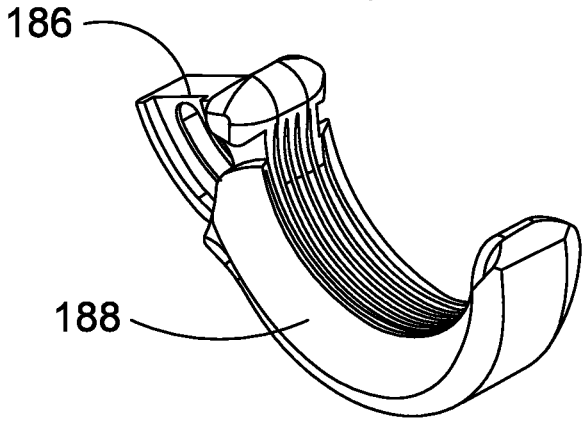

An alternate embodiment of the fourth or ring finger support 170 is shown in FIG. 27. As with the embodiment shown in FIGS. 3 and 26, the ring finger support 170 of FIG. 27 includes a slotted projection 168 for connection with the middle finger support 62. However, it further includes a rear slot 184 which is adapted to receive the projection 186 of a fifth or pinky finger support 188 shown in FIG. 28. A screw (not shown) connects the pinky finger support 188 with the fourth finger support 170 in the same manner as the fourth finger support is connected with the middle finger support.

Another feature of the release is the ability to lock the spring and trigger adjustments once set by the archer. In this regard and as shown in FIG. 3, the handle portion 4*a* includes a threaded opening 84 which communicates with the threaded opening 38. A ball 86 formed of nylon or other suitable material is arranged in the opening 84 and a set screw 88 is operable to press the ball against the spring adjustment screw 40 within the threaded opening 38. Thus, once the spring 26 is adjusted to the desired degree of pressure via the screw 40, the screw 40 is locked in place by the ball 86 and set screw 88. A similar ball 90 and set screw 92 assembly are arranged in a threaded opening 94 in the thumb trigger 42 to lock the trigger travel screw 57 in place after it has been adjusted to a desired position. If the trigger travel screw 57 is rotated too far in a clockwise direction, the forward end of the screw extends from the inner side of the thumb trigger and engages the ring sear while spacing the trigger end portion 42*a* from the notch 50 of the ring sear, thus preventing the thumb trigger from operating. Accordingly, the archer must adjust the trigger travel screw in a reverse direction which allows the trigger end portion 42*a* to move toward the ring sear and engage the notch. Once this position of the trigger travel screw is obtained, the set screw 92 is tightened to press the ball 90 against the trigger travel screw, the trigger travel is locked in the appropriate position.

While the preferred forms and embodiments of the invention have been illustrated and described, it will become apparent to those of ordinary skill in the art that various changes and modifications may be made without deviating from the inventive concepts set forth above.

What is claimed is:

1. A handheld pull tension archery release, comprising (a) a handle containing a finger opening having an axis arranged normal to a plane containing said handle;

(b) a bail connected with said handle for rotation about an axis parallel to said opening axis, said bail including at least one radially extending projection configured to hold a bowstring; and (c) a ring sear assembly arranged within said handle coaxial with said opening axis and operable between a hold position wherein said ring sear assembly engages said bail to prevent rotation of said bail and a release position wherein said ring sear assembly releases said bail for rotation to release the bowstring and fire an arrow in response to pull tension from the bowstring.

2. An archery release as defined in claim 1, and further comprising a spring arranged within said handle and abutting against said ring sear assembly for biasing said ring sear assembly toward said hold position.

3. An archery release as defined in claim 2, wherein said sear assembly includes a ring sear arranged within said handle for rotation about said opening axis, said ring sear having a circular configuration and including a first radial projection against which said spring abuts.

4. An archery release as defined in claim 3, wherein said ring sear includes a second radial projection spaced from said first radial projection, and further comprising a bail catch connected with said handle for pivotal movement about an axis parallel to said opening axis, said bail catch having a first end which abuts against said ring sear second projection and a second end configured to engage a bail projection when said ring sear is in said hold position, whereby when said ring sear is rotated to said release position, said bail catch pivots to release said bail which in turn rotates to release the bowstring.

5. An archery release as defined in claim 4, wherein an outer surface of said ring sear contains a notch between said first and second radial projections, and further comprising a thumb trigger pivotally connected with said handle and operable between a hold position wherein said thumb trigger engages said ring sear notch to prevent rotation of said ring sear and a release position wherein said thumb trigger is disengaged from said circular sear notch.

6. An archery release as defined in claim 5, and further comprising a trigger spring arranged between said handle and said thumb trigger for biasing said thumb trigger toward said hold position.

7. An archery release as defined in claim 5, and further comprising a cover connected with said handle for enclosing said ring sear assembly and a portion said thumb trigger.

8. An archery release as defined in claim 7, wherein said handle contains a circular channel, said ring sear being arranged in said channel.

9. An archery release as defined in claim 5, wherein said bail includes three equally spaced projections.

10. An archery release as defined in claim 2, wherein said spring has a first end which engages said ring sear assembly, and further comprising a screw connected with said handle for engaging a second end of said spring opposite said first end, said screw being operable to compress and release said spring.

11. An archery release as defined in claim 10, and further comprising a spring guide arranged between said screw and said spring second end.

12. An archery release as defined in claim 2, and further comprising at least one finger support connected with said handle.

13. An archery release as defined in claim 1, wherein said bail includes (a) a base containing a central opening for rotation about an axis; and (b) at least two projections extending radially from said base, each projection including a concave surface configured for receiving a bowstring and a sear surface.

14. An archery release as defined in claim 13, wherein said sear surface is arranged on a side of said projection opposite said concave surface.

15. An archery release as defined in claim 14, wherein said projections are equally spaced.

16. An archery release as defined in claim 15, wherein three projections extend radially from said base, each of said projections having identical configurations.

17. An archery release as defined in claim 16, wherein said projections are integral with said base.

* * * * *